US006921009B2

(12) United States Patent
Sato et al.

(10) Patent No.: US 6,921,009 B2
(45) Date of Patent: Jul. 26, 2005

(54) NAILING MACHINE

(75) Inventors: Satsuo Sato, Ibaraki (JP); Takuhiro Murakami, Ibaraki (JP); Kunio Yamamoto, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 24 days.

(21) Appl. No.: 10/279,974

(22) Filed: Oct. 25, 2002

(65) Prior Publication Data

US 2003/0080171 A1 May 1, 2003

(30) Foreign Application Priority Data

Oct. 26, 2001 (JP) ..... P.2001-329316

(51) Int. Cl.[7] ..... B25C 7/00

(52) U.S. Cl. ..... 227/119; 227/9; 227/10; 227/120

(58) Field of Search ..... 227/8, 9, 10, 119, 227/120; 173/156, 170, 171; 29/432, 432.1

(56) References Cited

U.S. PATENT DOCUMENTS 3,027,560 A * 4/1962 Nelson ..... 227/66
3,128,468 A * 4/1964 Bade ..... 92/163
3,494,530 A * 2/1970 Bade ..... 227/8
3,615,049 A * 10/1971 Obergfell et al. ..... 227/28
3,708,096 A * 1/1973 Burke, Jr. ..... 227/130
3,920,169 A * 11/1975 DeCaro ..... 227/136
4,566,619 A * 1/1986 Kleinholz ..... 227/8
5,197,646 A 3/1993 Nikolich

* cited by examiner

*Primary Examiner*—Steven Gerrity
*Assistant Examiner*—Chukwurah Nathaniel
(74) *Attorney, Agent, or Firm*—McGinn & Gibb, PLLC

(57) ABSTRACT

A nailing machine, in which a part constituting a nose is changed so as to increase the service life of a driver blade for driving a nail. The nailing machine includes a nose having a nose hole in which the nail is supplied, and the driver blade made of metal. At least a part of a surface of the nose hole to be in contact with a front surface of the driver blade is provided with a protective body. The protective body is made of an organic material or a composite material of an organic material and a metal material. Due to this, direct mutual contact of the metal parts is prevented.

8 Claims, 1 Drawing Sheet

NAILING MACHINE

BACKGROUND OF THE INVENTION

1. Field of the Invention

The present invention relates to a nailing machine, such as a pneumatic nailing machine, in which a part constituting a nose is improved so as to increase the service life of a driver blade for driving a nail.

2. Background Art

As well known, a nailing machine operates such that the driver blade is driven to move at high speed by the utilization of pressure of compressed air or the like, and the nailing machine drives a nail into an object to be worked. In the case of driving nails having round heads, which are connected by plastics or a wire, it is a common practice that the cross section of the driver blade is configured to be crescent or semicircular so as to avoid driving the adjacent nail.

Great impact force acts on the driver blade (referred simply to as "blade"). In the case of a blade having such a configured cross section, the gravity center of the blade is not aligned with the center line of the piston. The result is that a great bending is apt to occur in the blade. Due to this, the blade inevitably contacts with the nose hole surface. In this case, the metal surfaces contact each other at high speed. The contact surfaces are heated to be several hundreds degrees Celsius or higher locally, and alteration layers are formed in the surface regions of both the surfaces. In the blade, minute cracks are formed in the alteration layer and grow into fatigue fracture. The result is that the product service life is reduced. There is an approach to solve the problem in which the nose part is made of a sintered metal and impregnated with oil. However, it is the present state that the solution provided by this approach is still unsatisfactory.

SUMMARY OF THE INVENTION

Accordingly, an object of the present invention is to provide a nailing machine which is free from the defects of the conventional art and has increased life of the blade.

To achieve the above object, in the present invention, the nose hole includes a nose hole surface part that is made of an organic material or a composite material of an organic material and a metal material. With this novel and unique feature, the metallic members never directly contact each other at the part of the blade at which bending stress is generated when the nail is driven.

DETAILED DESCRIPTION OF THE PREFERRED EMBODIMENTS

Figure 1:
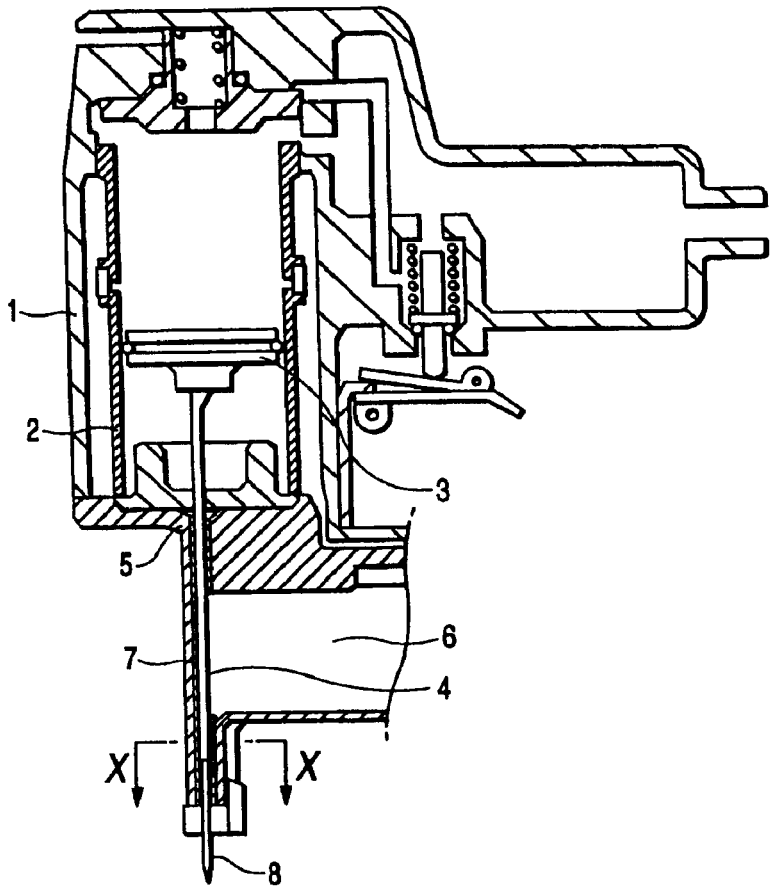
FIG. 1 is a cross sectional view showing an embodiment a nose of a nailing machine according to the present invention.
Figure 2:
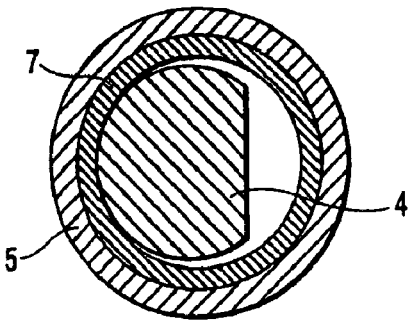
FIG. 2 is an enlarged cross sectional view taken on line X—X in FIG. 1.
Figure 3:
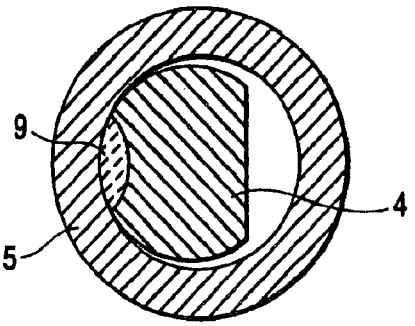
FIG. 3 (BACKGROUND ART)
FIG. 3 is a cross sectional view showing a conventional nose, which the view corresponds to that of FIG. 2.

An embodiment of the present invention will be described with reference to the accompanying drawings. In the figures, reference numeral 1 is a housing of the nailing machine body; 2 is a cylinder; 3 is a piston; 4 is a driver blade mounted on the piston 3; 5 is a nose which is provided in a lower part of the housing 1 and has a through hole through which the driver blade 4 and a nail 8 pass; 6 is a magazine for feeding nails to the nose hole; 7 is a nose hole surface part; 8 is a nail; and 9 is an alteration layer generated by quenching during high speed contact of the driver blade 4 with the nose 5.

The driver blade 4 mounted on the piston 3 drives nails 8 fed by the magazine 6 into an object to be worked. The nails 8 fed from the magazine 6 are generally connected together. A tip of the driver blade 4 is crescent or semicircular in cross section in order to avoid simultaneously driving two adjacent nails into the object. Accordingly, when the driver blade 4 is ejected at high speed under high pressure by the piston 3 and hits the connected nails 8, and when the nail 8 is driven into the object, a considerably large load acts on the driver blade 4, and bending stress is generated in the driver blade. As a result, metal contact parts under high speed and pressure condition are formed between the driver blade 4 and the nose hole surface part 7. The metal contact parts are instantaneously heated to have high temperature, and a quenching layer, called an alteration layer 9, having a thickness of several tens to several hundreds $\mu$m, is formed.

And, a softened layer is locally formed in a lower part of the layer. The alteration layer is 800 or higher in Vickers hardness, and very fragile. Accordingly, minute cracks are easy to be formed in the alteration layer. Fatigue fracture grows with the cracks of the alteration layer as starting points, and eventually the blade is broken down. This phenomenon frequently occurs.

In the nail driving driver blade 4 of which the tip is crescent or semicircular in cross section, the phenomenon is frequently found. And it is readily estimated that in any case, the breakdown starting points are present on the front side of the driver blade 4, i.e., a bending stress generated part. In the current nailing machine, the load acts on the driver blade 4, and hence, the contact of the driver blade 4 with the nose hole surface part 7 is unavoidable. Further, the driver blade 4 is moved while being in a cantilever fashion, and hence, it is very difficult to eliminate the vibration of the driver blade. Current efforts to solve the blade breakdown problem are directed to improvement of the material and mass of the driver blade 4. In the light of gaining high output and weight reduction, engineers are required to take another approach to increase the service life of the driver blade 4. For the above background reasons, the present inventors expended much effort to improve the material of the nose hole surface part 7 which is in contact with the driver blade 4, with an intention of increasing the life of the driver blade 4. It is inevitable that the driver blade 4 contacts the nose hole surface part 7. Therefore, we suppressed the heat generation at this part when those parts contact each other, and succeeded in preventing the formation of the alteration layer 9, and in increasing the lifetime of the driver blade 4. In the case of the driver blade 4 having a crescent or semicircular tip to which our creative efforts are directed, an organic material or a composite material of a metal material containing the organic material, not an iron-based metal, is used for the material constituting the nose hole surface part 7.

With use of such kinds of materials, the service life of the driver blade 4 is successfully increased. As described above, the whole or part of the nose hole surface part 7 in contact with the front surface of the driver blade is a protective part made of an organic material or a composite material including an organic material and a metal material. This technical feature is employed for minimizing the heat generation when the nose hole surface part 7 is in contact with the driver blade 4. Specifically, an engineering plastic, e.g., polyacetal or reinforced nylon, is used to obtain a lubricity, and its elastic deformation is utilized to lessen the contact resistance of the driver blade 4, whereby the amount of generated heat is reduced. To form a composite material of the organic material and the metallic material, it is preferable that the metallic material be porous and be impregnated with the organic material, or that the organic material be mechanically fixed to the porous metallic material. The porous material is used for maintaining strength of the nose hole surface part 7 or providing lubricity. Accordingly, so long as the porous material is metallic, it should be avoided that such a structure be employed as to allot the entire bending stress of the driver blade 4 to the porous material part. The material should have a strength capable of enduring such bending stress. Sometimes, the porous material is impregnated with oil for the purpose of providing supplemental lubrication. In the invention, an area of the protective part is the entire or part of the hole of the nose 5. The reason for this follows. If the driver blade 4 does not contact the nose 5, no problem arises. Therefore, if the mechanism clearly shows the contact part, it suffices that the protective part is applied to only that contact part. So long as the blade per se moves, vibration inevitably occurs in the driver blade 4 and varies also depending on movement conditions. When this fact is taken into consideration, it is most preferable that the protective part be formed over the entire hole of the nose.

Further, the invention has a characteristic feature that the nose hole surface part 7 is integrated into the nose hole surface part by fitting or the like. With this feature, the nose hole surface part 7 is formed in the simplest manner, and it is replaceable with another new one. The organic material is much lower in hardness than the metallic material. Accordingly, it is excellent in lubricity, but the wear life of it is inevitably shorter than that of the metallic material. When with its contact with the nail 8 and the driver blade 4, the wear of the nose hole surface part 7 progresses to an extent in excess of a predetermined level, it is convenient that only the nose hole surface part 7 may be replaced with a new one.

As seen from the foregoing description, the invention prevents the bending stress generated part of the driver blade from coming in direct metal contact with the metal part of the nose. Accordingly, an alteration layer is not formed in the surface region of the nose hole surface part 7, and fatigue breakdown starting from the alteration layer does not occur. Consequently, increase of the service life of the driver blade is ensured.

What is claimed is:

1. A nailing machine for driving a nail, said nailing machine comprising:

a housing having a nose with a nose hole extending therethrough;

a driver blade slidable within the nose hole, for hitting nails supplied in the nose hole; and a nose hole surface part within the nose hole to be in contact with a surface of the driver blade, the nose hole surface part comprising a porous metallic material and an organic material impregnated in the porous metallic material, the nose hole surface part minimizing wear on the driver blade as the driver blade slides within the nose hole while hitting the nails.

2. The nailing machine as claimed in claim 1, wherein the driver blade has a non-circular cross section.

3. The nailing machine as claimed in claim 1, wherein the nose hole surface part is press-fitted within the nose.

4. The nailing machine as claimed in claim 1, wherein the nose hole surface part is affixed within the nose hole to substantially prevent movement of the nose hole surface part relative to the nose as the driver blade slides within the nose hole while hitting nails.

5. A nailing machine for driving a nail, said nailing machine comprising:

a housing having a nose with a nose hole extending therethrough;

a driver blade slidable within the nose hole, for hitting nails supplied in the nose hole; and a nose hole surface part within the nose hole to be in contact with a surface of the driver blade, the nose hole surface part comprising a material that is a composite of an organic material and a metal material so as to minimize wear on the driver blade as the driver blade slides within the nose hole while hitting nails, wherein the organic material is impregnated in the metal material.

6. The nailing machine as claimed in claim 5, wherein the driver blade has a non-circular cross section.

7. The nailing machine as claimed in claim 5, wherein the nose hole surface part is press-fitted within the nose.

8. The nailing machine as claimed in claim 5, wherein the nose hole surface part is affixed within the nose hole to substantially prevent movement of the nose hole surface part relative to the nose as the driver blade slides within the nose hole while hitting nails.

* * * * *